United States Patent [19]

LaBarge

[11] Patent Number: 4,957,216

[45] Date of Patent: Sep. 18, 1990

[54] ANCHOR FOR PLASTIC CAP

[75] Inventor: Robert L. LaBarge, Ben Avon Borough, Pa.

[73] Assignee: Aluminum Company of America, Pittsburgh, Pa.

[21] Appl. No.: 338,580

[22] Filed: Apr. 17, 1989

[51] Int. Cl.[5] ..... B65D 55/00

[52] U.S. Cl. ..... 220/379; 220/85 CH

[58] Field of Search ..... 220/253, 254, 258, 336, 220/379, 85 CH; 215/306

[56] References Cited

U.S. PATENT DOCUMENTS

| | | | |
|---|---|---|---|
| 2,033,042 | 3/1936 | Mazzella | 220/336 |
| 3,807,597 | 4/1974 | Wells et al. | 220/48 |
| 3,902,626 | 9/1975 | Jordan et al. | 220/268 |
| 3,912,114 | 10/1975 | Morran et al. | 220/268 |
| 3,929,251 | 12/1975 | Urmston | 220/268 |
| 3,938,455 | 2/1976 | Urmston | 113/121 |
| 3,946,683 | 3/1976 | Jordan | 113/15 |
| 3,977,341 | 8/1976 | Jordan et al. | 113/15 |
| 3,997,076 | 12/1976 | Jordan | 220/268 |
| 4,024,981 | 5/1977 | Brown | 220/269 |
| 4,039,101 | 8/1977 | Wells | 220/269 |
| 4,148,410 | 4/1979 | Brown | 220/269 |
| 4,339,053 | 7/1982 | Tarro | 220/269 |
| 4,345,696 | 8/1982 | Guimasin | 220/277 |
| 4,442,950 | 4/1984 | Wilson | 220/269 |
| 4,648,528 | 3/1987 | LaBarge et al. | 220/240 |
| 4,673,099 | 6/1987 | Wells | 220/269 |
| 4,678,096 | 7/1987 | LaBarge et al. | 220/273 |
| 4,685,849 | 8/1987 | LaBarge et al. | 413/22 |
| 4,783,985 | 11/1988 | LaBarge et al. | 72/379 |
| 4,793,510 | 12/1988 | Arfert et al. | 220/306 |

*Primary Examiner*—Stephen Marcus
*Assistant Examiner*—Nova Stucker
*Attorney, Agent, or Firm*—David W. Brownlee; Robert E. Isner

[57] ABSTRACT

This invention relates to an improved can end construction for beverage cans having a score line defined panel therein for beverage dispensing and, more particularly, to an improved can end construction for releasably positioning a displaceable resealing cap assembly at a predetermined location on a container end closure.

9 Claims, 2 Drawing Sheets

ANCHOR FOR PLASTIC CAP

BACKGROUND OF THE INVENTION

Recent years have witnessed ever increasing quantities of beverages, such as beer, carbonated soft drinks and juices, being packaged in amounts of up to 12 ounces in metal cans and particularly in metal cans with ends that include a score line defined opening panel therein to provide implement free access to the contents. Such opening panel containing can ends are generally called "easy open ends" and include variant basic constructions of a first type wherein the score line completely circumscribes the panel and thus renders the panel completely separable from the can end and of a second type wherein the score line only partially circumscribes the panel to render the latter only partially severable from the can end and to thus remain in attached relation within the can after the pouring opening has been formed. As mentioned above, such opening panels are conventionally perimetrically delineated by score lines of decreased metal thickness.

In order to extend the use of such easy open can end constructions to larger volume containers, the art has suggested the utilization of a cap assembly to close and reseal the opening defined by such score line defined panel. Among the objects of such cap utilization are a re-closure of the container to prevent loss of liquid content and a resealing of the container to limit further losses of the dissociable gases, i.e., the "carbonation", in the remaining liquid contents. U.S. Pat. No. 4,580,692 discloses one construction for such a resealable closure cap assembly in association with a selectively contoured can end construction to cooperatively accommodate such resealable closure and to retain the advantages characteristic of the "easy open end" construction.

The provision of commercially acceptable resealable easy open can end constructions for larger capacity beverage containers requires in addition to the functional features of present easy open ends both sealable retention of the can contents and accommodation by the resealed cap of the inherent pressure buildup therein. Also required is a can end configuration at the pouring opening to accommodate the displacement and disposition of a resealing cap into and out of operative relation with the pouring aperture therein without diminution of the convenience and cost effective nature of the basic easy open end constructions during manufacturing, filling, shipping, selling, and consumer usage thereof. At least a portion of the cost effective nature of easy open end can closures is attributable to the preliminary fabrication of the end closure and the automatic sequential feeding of such end closures into operative proximity with the open end of a filled can and subsequent hermetic connection therewith by a conventional "double seaming" techniques and machinery. The addition of a resealable cap assembly to the end closure requires accommodation of problems not heretofore met in the basic easy open end constructions conventionally employed in the smaller capacity beverage cans.

Experience to date with the resealable cap assembly and can end construction disclosed in U.S. Pat. Nos. 4,580,692 and 4,648,528, the disclosure contents of which are herein incorporated by reference, has indicated a basically antithetical relationship between the need to mount the generally resilient and flexible resealing cap assembly on the end closure in such manner as to permit its displacement into and out of sealing relationship with the pouring aperture therein and the need to positively and securely fix the position of said cap assembly at one predetermined and uniform location prior to, during and after securement of the cap assembly to the end closure, through the "double seaming" of the end closure to the filled container and during the subsequent handling and stacking thereof.

SUMMARY OF THE INVENTION

This invention may be briefly described as an improved resealable easy open end closure construction for beverage cans and the like that includes, in its broader aspects, the interposition of a snap fastener assembly intermediate a displaceable resealing cap assembly and the container end closure to releasably secure the cap assembly in interfacial abutting relation with the surface of the container end closure. In a somewhat narrower aspect, the invention includes a resealable end closure construction that includes an upwardly extending cylindrical button-like element in the end closure wall and a complemental sleeve element attached to the resealing cap assembly sized to compressively surround said button-like element for releasable engagement therewith.

Among the advantages of the subject invention is the permitted retention of a resealable cap assembly in releasable interfacial abutting engagement with the surface of a container end closure at one predetermined and uniform location thereon prior to, during and subsequent to securement of the end closure to a container. A further advantage of the subject invention is the permitted releasable securement of a resealing cap assembly to an easy open end closure for containers without interference with the permitted displacement of the resealing cap assembly from a first location remote from a score line defined opening panel therein and a second location wherein said cap assembly is disposed in overlying sealing relation with said panel defined opening therein.

The object of this invention is the provision of an improved construction for a resealable end closure for easy open end beverage containers and the like.

Other objects and advantages of the invention will become apparent from the following portions of this specification and from the appended drawings which illustrate, in accord with the mandate of the patent statutes, a presently preferred embodiment of a can end closure construction that incorporates the principles of this invention.

DETAILED DESCRIPTION OF THE INVENTION

Figure 1:
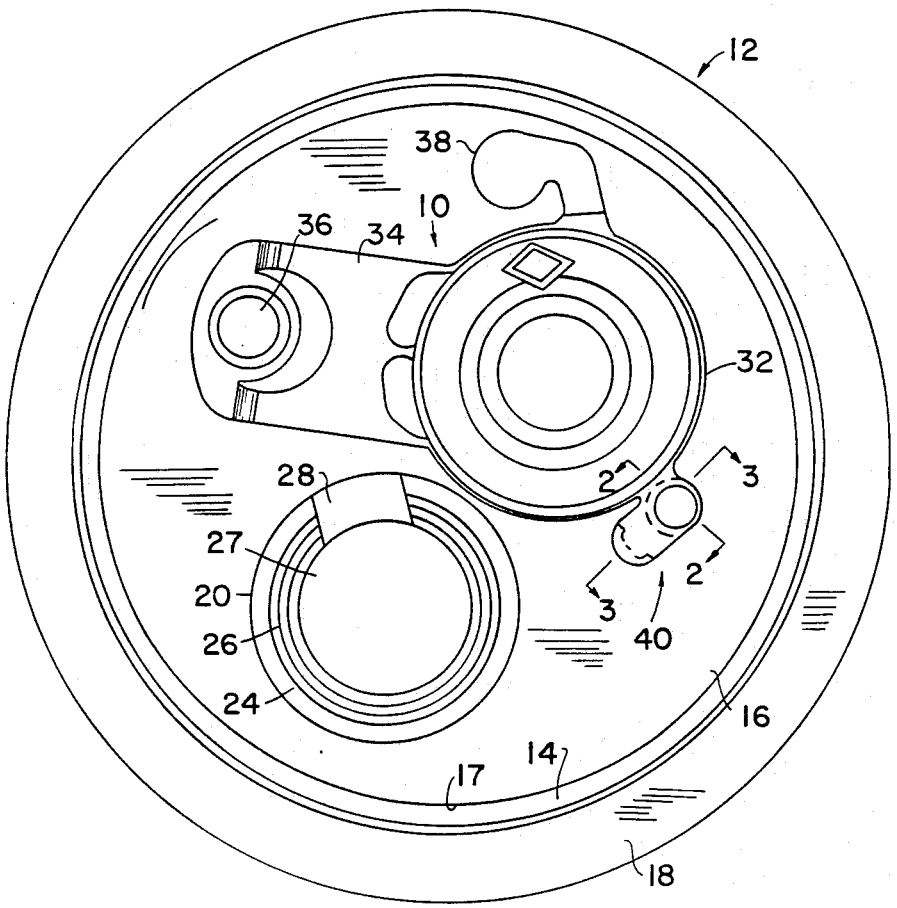
FIG. 1 is a plan view of a releasably anchored resealing cap assembly incorporating the principles of this invention.

As pointed out above, the invention will be described in association with a resealable easy open end construction of the general type disclosed in U.S. Pat. Nos. 4,580,692 and 4,648,528, the disclosure contents of which are herein incorporated by reference. However, it should be understood that the invention may be used in association with other resealing cap assemblies for easy open end can constructions.

Where the words "upwardly", "inward", "outwardly", "under", and the like are used hereinafter, their meaning is to be taken with reference to a can in an upright position having a can end closure incorporating this invention attached to the top end thereof.

Referring to the drawings, an anchoring system for a resealing cap assembly incorporating the principles of this invention is disclosed in association with a can end closure 12 prior to the can end closure's engagement with a can body by double seaming. The can end closure 12 includes a substantially flat or planar end wall portion 16, a countersink defining inner sidewall 17 and an outer sidewall 14 terminating in an upwardly and outwardly projecting annular flange 18 forming a chime for conventional attachment of the can end to a can body by double seaming.

The can end closure 12 further includes an upwardly projecting dispensing spout 20 formed as an integral portion thereof. Such spout 20 includes a top wall 24 having a score line 26, interrupted by a hinge 28, partially circumscribing and defining an opening panel 27 depressible inwardly of the can by fracture of the score line. Associated with the dispensing spout 20 is a resealing cap assembly, generally designated 10, preferably molded in one piece using a plastic material having a low modulus of elasticity, such as, for example low density polyethylene. The resealing cap assembly 10 includes a sealing cap portion 32 adapted to be placed in sealing relation over the spout 20 and the score line defined opening panel 27 therein, an arm 34 extending from the sealing cap portion 32 and a tab 38 projecting outwardly from the sealing cap portion 32 for convenience in manipulation of the cap. The cap assembly 10 is pivotally attached to the end wall 16 with a rivet 36 through an appropriate opening in a boss located at the remote end of the extending arm 34. The rivet 36 flange is suitably formed when the rivet is staked to attach the resealing cap assembly 10 to the can end 12 to insure that there is sufficient engagement between the rivet 36 and the arm 34 to maintain the sealing cap assembly 10 in a secured relation to the can end, but also to permit the sealing cap portion 32 to be rotated by hand about the rivet 36 to permit its positioning over the pouring spout 20. Preferably, the rivet 36 is an integrally formed portion of the end wall 16.

As pointed out earlier, experience to date with the sealing cap construction generally disclosed in U.S. Pat. No. 4,580,692 has shown that certain difficulties may exist in effecting the automated attachment of the end closure to a filled container due to a prior undesirable displacement of the resealing cap assembly 10 from either abutting interfacial relation with the end wall 16 due to curling or the like and/or by an undesired pivotal displacement of the resealing cap assembly 10 from a predetermined desired location thereof on the panel 16 surface. Such undesired displacements of the resealing cap assembly from a predetermined location are most notably reflected in impediments to the proper stacking, feeding, and manipulation of the prefabricated and preassembled end closures in the automated equipment conventionally employed in the attachment of the end closure to the container subsequent to the filling thereof.

Figure 2:
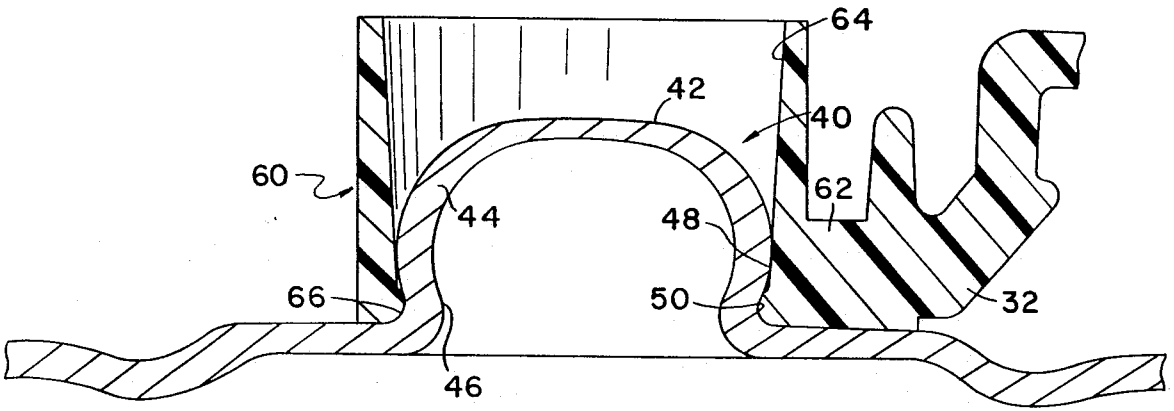
FIG. 2 is a section as taken on the line 2—2 in FIG. 1 and of expanded scale.
Figure 3:
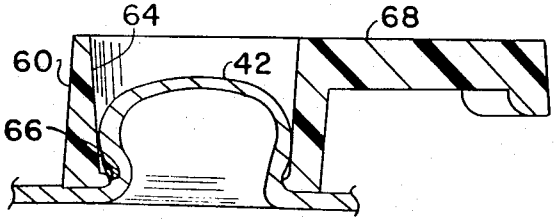
FIG. 3 is a section as taken on the line 3—3 in FIG. 1 and of expanded scale.

In order to properly locate the resealing cap assembly 10 in a predetermined location on the end wall 16 and to insure against undesired displacement thereof prior to a desired opening of the opening panel 27, a releasable fastening assembly, generally designated 40, is incorporated intermediate the free end of the cap assembly 10 and end panel wall 16. As best shown in FIG. 1, the fastening assembly is located essentially tangent to the periphery of the sealing portion 32 and in spaced relation from both the countersink wall 17 and spout assembly 20. The fastening assembly 40 includes an upwardly extending bubble-like button member 42 integral with end panel 16 and suitably formed concurrent with the other metal deformation operations performed thereon. The button member 42 is preferably shaped to provide a bulbous upper portion 44 and an underlying stem portion 46. As best shown in FIGS. 2 and 3, the bulbous upper portion has a maximum outside diameter 48 that is larger than that of the stem diameter 50 so as to effectively overhang the latter. In complemental association with the button member 42, the resealing cap assembly 10 includes an integral sleeve member 60 disposed adjacent to the periphery of the sealing portion 32 and interconnected thereto by a web 62. The sleeve member 60 includes a downwardly tapering bore 64 sized to compressively surround the bulbous upper portion 44 of the button member 42 and an inwardly directed shoulder 66 at its lower end sized to be elastically displaceable past the bulbous upper portion 44 and to be received in surrounding interfacial relation with the undercut stem portion 46 thereof. Extending from the upper end of the sleeve member 60 and adapted to be positioned in spaced relation with the surface of end wall 16 is a manually engageable tab 68 to facilitate separation of the sleeve 60 from the button member 42.

As will now be apparent, the sleeve member 60 is readily fabricated as an integral component of the releasable cap assembly 10 during the molding operation. Likewise, and as previously pointed out, the button member 42 is readily formed by appropriate die assemblies concurrent with the formation of the spout assembly 20, rivet 36, and other metal deformed components of the end panel 16. Subsequent to the individual formation of the releasable cap assembly 10 and at the appropriate stage in the formation of the end panel 16, the former is secured in interfaced relation to the latter by the staking of the rivet 36 and secured in predetermined location thereon by the interfacial engagement of the sleeve member 60 with the button member 42 as above described. The described fastening serves to minimize, if not avoid, deleterious curling of the cap assembly 10 and undesired pivotal displacement of the cap assembly about the rivet 36 during the operations attendant subsequent attachment of the prefabricated end closure to a filled container and all subsequent packaging and handling operations precedent to the opening of the can by severance of the score line 26.

As disclosed in greater detail in U.S. Pat. Nos. 4,580,692 and 4,648,528, the preferred method of severance of the score line 26 is effected by pivotally displacing the sealing portion 32 of the cap assembly 10 into overlying relation with the spout 20 and applying downward pressure at a preferred location on the seal portion periphery. Release of the cap assembly 10 from its normally secured position remote from the spout 20 is readily effected by manually lifting the tab 68 and sleeve member 60 out of secured relation with the button member 42 by the ultimate consumer immediately prior to opening the can, as described above.

As will now also be apparent to those skilled in the art from the foregoing description and drawings herein, the location and design of the snap assembly must be such as to conform to certain spatial limitations and manufacturing considerations. In more particularity, the button member 42 must be located sufficiently remote from the countersink defining wall 17 and spout assembly 20 to permit its integral formation from the end wall 16 without deleterious interference with the concurrent formation and functioning of the countersink and spout portions of the end closure. Similarly, the sleeve assembly has to be located at the far end of the cap assembly 10 and in a position that will accommodate the lifting tab 68 both in its original position and also when the resealing portion 32 is positioned in resealing relation with the spout 20.

Having thus described my invention, I claim:

1. A closure for closing the open mouth of a container comprising:

an end wall having a score line defined panel defining a pouring opening therein for dispensing of the container contents, means around the periphery of the end wall for attaching the closure to a container, a flexible resealing cap assembly pivotally secured to said end wall and rotatably displaceable about the locus of securement thereof for transposition immediate a first location remote from said score line defined opening panel in said end wall and a second location in overlying sealing relation with said pouring opening therein, and means for releasably anchoring said cap assembly in interfacial abutting relation with said end wall at said first location, wherein said anchoring means includes upwardly extending button means in said end wall positioned in spaced relation from said score line defined panel therein and from said peripheral attaching means, and a flexible sleeve member included in said cap assembly sized to elastically surround said button means for releasable engagement therewith.

2. A closure as set forth in claim 1 wherein:

said cap assembly includes a sealing portion engageable in overlying sealing relation with said pouring opening, and said flexible sleeve member is positioned adjacent to the periphery of said sealing portion.

3. A closure as set forth in claim 1 wherein said button means is integral with said end wall.

4. A closure as set forth in claim 1 wherein an upper end portion of said button means is of greater external diametric extent than a lower portion of said button means disposed intermediate said upper portion thereof and the end wall surface.

5. A closure as set forth in claim 1 wherein said sleeve member includes a bore whose lower end portion is of lesser diametral extent than the upper portions thereof.

6. A closure as set forth in claim 4 wherein said sleeve member includes a bore dependently terminating in an inwardly directed shoulder sized to compressively engage said lower portion of said button means.

7. A closure as set forth in claim 1 wherein said sleeve member includes a manually graspable extending tab portion.

8. A closure for closing the open mouth of a container comprising:

an end wall having a score line defined panel defining a pouring opening therein for dispensing of the container contents, means around the periphery of the end wall for attaching the closure to a container, a flexible resealing cap assembly pivotally secured to said end wall and rotatably displaceable about the locus of securement thereof for transposition intermediate a first location remote from said score line defined opening panel in said end wall and a second location in overlying sealing relation with said pouring opening therein, means for releasably anchoring said cap assembly in interfacial abutting relation with said end wall at said first location, said anchoring means including upwardly extending button means in said end wall positioned in spaced relation from said score line defined panel therein and from said peripheral attaching means, said flexible cap assembly including a sealing portion engageable in overlying sealing relation with said pouring opening, and a flexible sleeve member positioned adjacent to said sealing portion and sized to compressively surround said button means for releasable engagement therewith.

9. A closure as set forth in claim 8 wherein said button means is integral with said end wall.

* * * * *